US005632570A

United States Patent [19]

Balling

[11] Patent Number: 5,632,570

[45] Date of Patent: May 27, 1997

[54] ELECTRIC ROTARY TROWEL

[76] Inventor: Curtis Balling, 405 Belmont St., Lakefield, Minn. 56150

[21] Appl. No.: 502,936

[22] Filed: Jul. 17, 1995

[51] Int. Cl.[6] ..... E01C 19/22

[52] U.S. Cl. ..... 404/112; 404/118

[58] Field of Search ..... 404/102, 112, 404/118, 97; 451/353

[56] References Cited

U.S. PATENT DOCUMENTS

| | | | |
|---|---|---|---|
| 2,888,863 | 6/1959 | Eisenbeis | 404/112 |
| 3,412,657 | 11/1968 | Colizza et al. | 404/112 |
| 3,477,353 | 11/1969 | Rebechini | 404/112 |
| 4,046,483 | 9/1977 | Sutherland | 404/112 |
| 5,372,452 | 12/1994 | Hodgson | 404/112 |

FOREIGN PATENT DOCUMENTS

| | | | |
|---|---|---|---|
| 1149881 | 6/1963 | Germany | 404/112 |
| 672309 | 7/1979 | U.S.S.R. | 404/112 |

*Primary Examiner*—James Lisehora
*Attorney, Agent, or Firm*—Herman H. Bains

[57] ABSTRACT

A rotary trowel device includes a substantially horizontal shroud having an electric motor assembly mounted on the upper surface thereof, and having a rotary trowel blade assembly located below the shroud. The trowel blade assembly includes a hub connected to an output shaft of the electric motor assembly. The trowel blades are shiftable between tilted and non-tilted position by components located within the hub.

7 Claims, 3 Drawing Sheets

ELECTRIC ROTARY TROWEL

BACKGROUND OF THE INVENTION

1. Field of the Invention

This invention relates to troweling devices and more particularly to power driven rotary troweling devices for finishing concrete surfaces.

2. Discussion of the Prior Art

Rotary trowel devices have been used in forming and finishing concrete structures such as floors, driveways and other types of masonary structures. The conventional rotary trowel devices are powered by gasoline engines which severely limits their utility. For example, gasoline powered rotary trowels are unacceptable for inside work because of the toxic and noxious emission gases produced during operation the gasoline engines.

During the troweling operation, the freshly poured concrete, which is in a slurry condition, must be efficiently spread. Thereafter, the concrete is evenly finished during the final stages of troweling. In order to efficiently spread the freshly poured concrete, it is desirable to tilt the troweling blades from the normal horizontal position which is used in the final finishing of the surface. The angle of attack or tilt may be diminished as the concrete begins to set.

There are certain prior art patents which disclose rotary power trowels including U.S. Pat. No. 4,232,980 to Tertinek which is directed to a gasoline powered rotary trowel. While the Tertinek patent also discloses a trowel blade tilt mechanism, it will be noted that the blades are pivoted to a stabilizer ring and are shifted by an actuating system having all the components exposed and located outside the hub of the trowel blade assembly.

U.S. Pat. No. 3,259,033 to Kelly discloses a blade assembly for a trowel machine which the blades are tilted by a blade tilting mechanism in which all of the components are located externally of the hub.

U.S. Pat. No. 2,468,981 to Huffman discloses a trowel machine in which the trowel blades are driven by an output shaft that extends laterally from the power source. The trowel blades are tilted through the use of bevel gears attached to the inner ends of the blade shafts.

U.S. Pat. No. 4,312,603 to Whiteman discloses a power driven twin trowel machine which is structurally and functionally different from Applicant's trowel machine.

Applicant also disclosed a prior prototype troweling machine at an inventor's congress but the prototype machine did not include many of the features of the present machine and did not specifically include the tilting mechanism disclosed in the instant application.

SUMMARY OF THE INVENTION

It is a general object of this invention to provide an electrically driven rotary trowel device which is especially adapted for use in confined areas. The rotary trowel device is provided with a rotary trowel blade assembly having a unique tilting system which allows the blades to be readily tilted between flat and angular relationship.

The rotary trowel device includes an electric motor assembly mounted on an imperforate shroud and is drivingly connected to the trowel blade assembly located below the shroud. The electric motor assembly includes a DC electric motor having a vertically disposed output shaft which is drivingly connected to a gear reduction mechanism whose output shaft is disposed in axial alignment with the motor output shaft. The trowel blade assembly includes a plurality of substantially flat trowel blades interconnected to a hub by a tilt mechanism which permits ready tilting of the blades between a substantially flat and tilted positions. The rotary trowel device is provided with a handle having suitable controls including a combination rectifier and potentiometer for controlling operation of the DC motor.

DESCRIPTION OF THE PREFERRED EMBODIMENT

Figure 1:
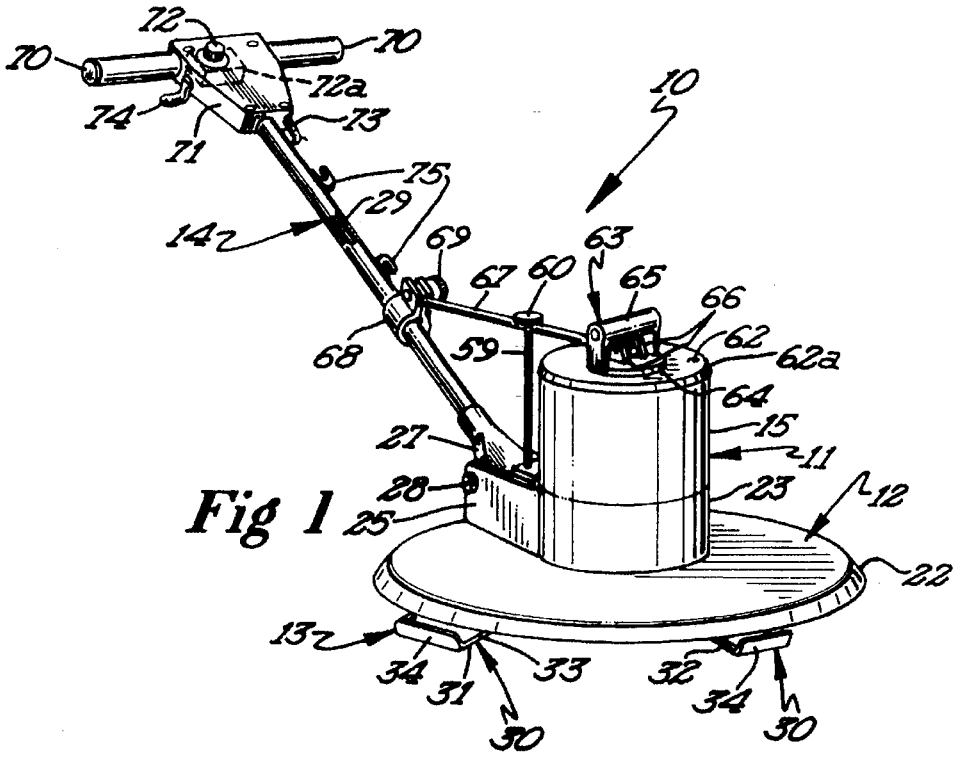
FIG. 1 is a perspective view of the novel rotary trowel device.

Referring now to the drawings and more specifically to FIG. 1, it will be seen that one embodiment of the novel rotary trowel device, designated generally by the reference numeral 10, is thereshown. The rotary trowel device 10 includes an electric motor assembly 11 which is mounted upon the upper surface of a substantially flat, horizontal imperforate shroud 12. The rotary trowel device 10 also includes a rotary trowel blade assembly 13 which is drivingly connected to the electric motor assembly 11 and is positioned below the shroud 12. An elongate handle 14 is pivotally connected to a component of the electric motor assembly 11 and serves to facilitate operation of the troweling device.

The electric motor assembly 11 includes a 1.5, 3000 RPM, 15 amp, 120 v DC electric motor 15 and having a vertically disposed downwardly extending output shaft 16. The output shaft 16 is drivingly connected to a gear reduction device 17 including a housing **17*b* which engages the lower wall 17*a* of the electric motor housing. The gear reduction device 17 has a reduced lower end portion 18 through which the output shaft 19 projects. It will be noted that the output shaft 19 is disposed in axial alignment with the output shaft 16 of the DC electric motor. The gear reduction device 17** is a direct in line helical gear drive and includes hardened helical gears and pinion with suitable ball bearing assemblies.

Figure 4:
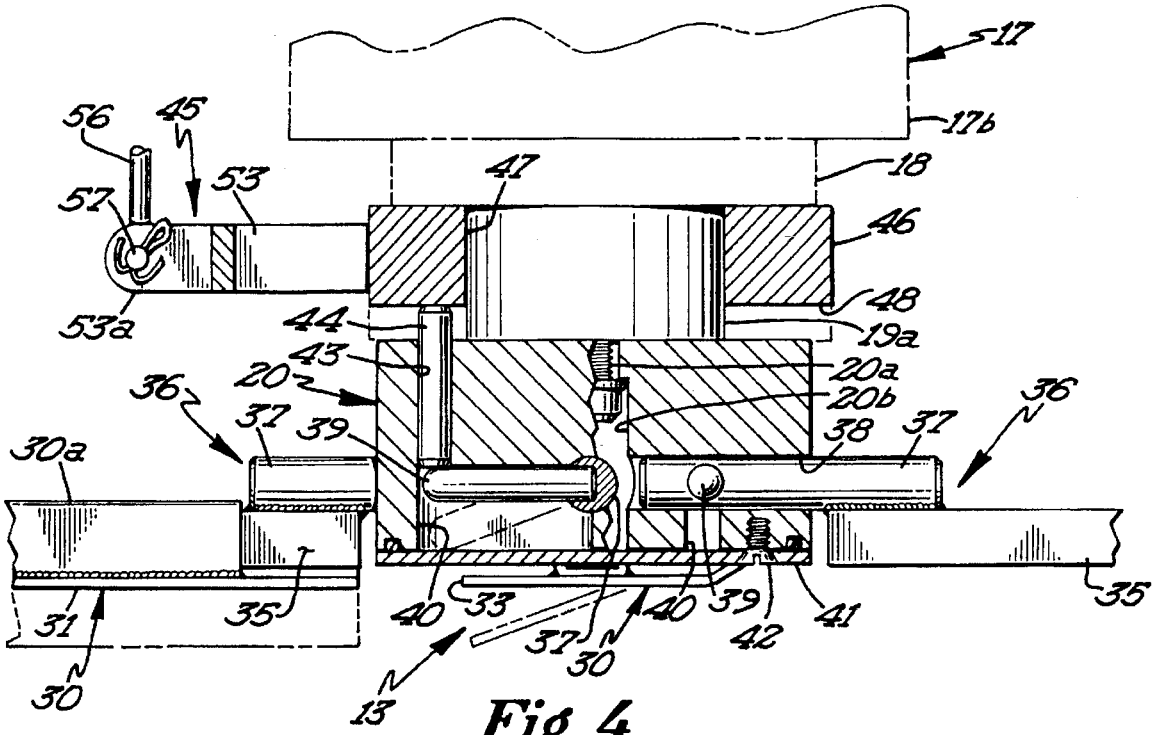
FIG. 4 is cross-sectional view taken approximately along line 4—4 of FIG. 3 and looking in the direction of the arrows with certain parts thereof illustrated in an adjusted position by a phantom line configuration.

A cylindrical hub 20, as best seen in FIG. 4 has a central bore **20*b* therethrough for accommodating a bolt 20*a* which secures the hub to the lower end of the output shaft 19 of the gear reduction device 17. It will be noted that the hub 20 extends through a central opening 21 in the shroud 12 and it will further be noted that the shroud 12 has downturned peripheral of circumferential edges 22. The central hub 20** is secured to the trowel blade assembly which is described more fully hereinbelow.

Figure 2:
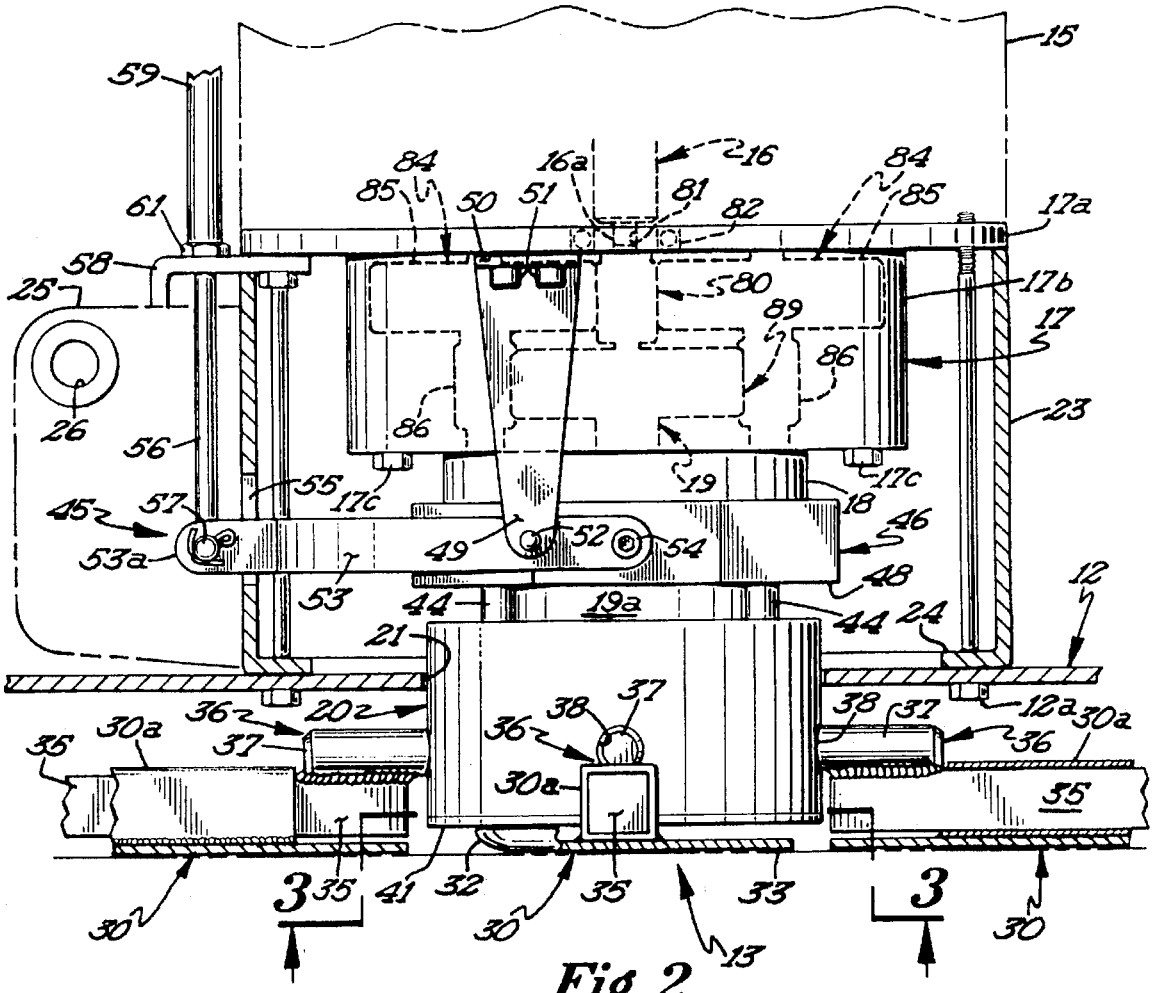
FIG. 2 is a fragmentary side elevational view of the trowel device illustrating certain components thereof.

Referring now to FIGS. 6 and 7, the various components of the gear reduction device 17 are thereshown. The output shaft 16 for the electric motor 15 has a reduced square tongue **16*a* extending from the lower end thereof. The tongue 16*a* engages in a squared slot or opening 81 in at pinion gear 80 which is journaled in an upper ball bearing 82 carried by the lower wall 17***a* of the electric motor 15. The various gears of the gear reduction device are diagrammatically shown in FIG. 2 by dotted line configuration. The lower end of the pinion gear 80 is journaled by lower ball bearing (not shown) in the upper enlarged end of the output shaft 19 of the gear reduction device 17.

The pinion gear 80 is in meshing relation with a pair of helical gears 84. It will be noted that each helical gear 84 includes an upper helical gear element 85 which meshes with the pinion gear 80. Each helical gear 84 also includes a reduced lower gear element 86. Is pointed out that each helical gear 84 is journaled by a ball bearing (not shown) in the lower wall 17*a* of the electric motor 15 and is journaled in a lower ball bearing (not shown) mounted in the lower wall of the gear reduction housing 17*b*. Bolts 17*c* secure the gear reduction housing to the lower wall of the electric motor assembly.

Each of the lower helical gear elements 85 is disposed in meshing relation with a helical gear 89 which is secured to the upper end of the output shaft 19 by a key (not shown). The output shaft is journaled in the lower wall of the gear reduction device housing 17*b* by a ball bearing (not shown). It will be noted that the output shaft 16 of the electric motor 15 is disposed in axial alignment with the output shaft 19 of the gear reduction device. The output shaft 19 has a collar 19*a* secured thereto and rotatable therewith. The hub 20 and trowel blade assembly 13 are suspended from the output shaft 19 and collar 19*a*.

The means for mounting the electric motor assembly on the shroud 12 comprises a cylindrical cover 23 which is vertically disposed and which has an inturned annular flange 24 integral with its lower end and being suitably apertured so that the apertures therein are disposed in registering relation with similar apertures in the shroud 12. Elongate bolts 12*a* extend through the registering apertures in the flange 24 and the apertures in the shroud 12 and extend through corresponding aligned apertures in the outwardly extending lower wall 17*a* of the electric motor 15. The lower end of the electric motor 15 has threaded apertures therein that are disposed in registering relation with the apertures in the radial flange 24 and threadedly receives the bolts 24*a*. Thus it will be seen that the cylindrical cover 23 is secured to the electric motor assembly and to the shroud 12.

The vertically disposed cylindrical cover 23 is provided with a pair of laterally spaced apart substantially parallel bracket plates 25 rigidly secured thereto and projecting outwardly therefrom. The bracket plates 25 each has an opening 26 therein and these openings are disposed in alignment with each other. The lower end of the handle 14 projects through a cylindrical opening in the bracket 27 and is secured to the bracket by a suitable bolt. Pivot bolts 28 pivotally secure the bracket 28 to the bracket plates 25 to permit the handle 14 to be pivoted relative thereto. It will be noted that the handle 14 is hollow and accommodates a conductor cable 29 that includes electrical conductors that are connected to the DC electric motor 15.

Referring now to FIGS. 2–5, it will be seen that the trowel blade assembly includes a plurality of similar elongate trowel blade members 30 which are secured to the hub 20 of the trowel blade assembly and project radially outwardly therefrom. Each trowel blade member includes a substantially flat trowel blade element 31 having a slight upturned leading edge 32 and a trailing edge 33. It also will be noted that the outer end edge 34 of each flat trowel blade 31 is also slightly upwardly swept.

Figure 3:
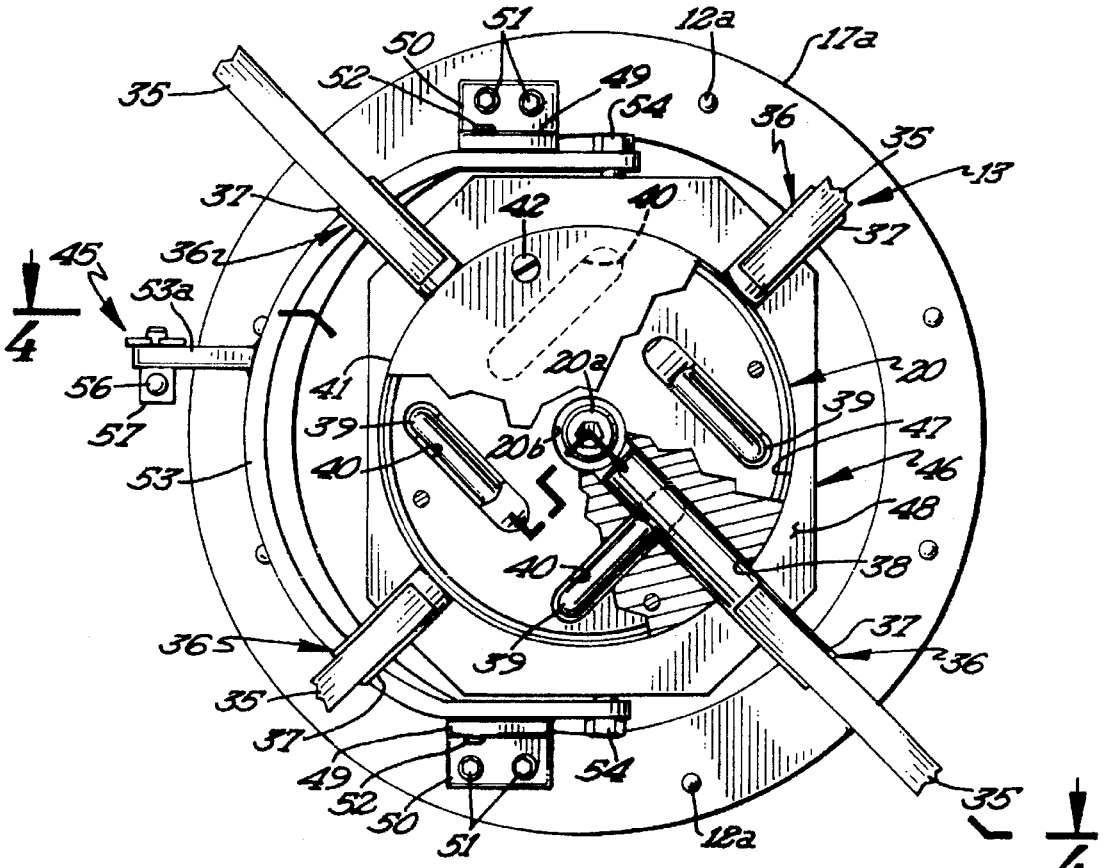
FIG. 3 is a cross-sectional view taken approximately along line 3—3 of FIG. 2 and looking in the direction of the arrows.
Figure 5:
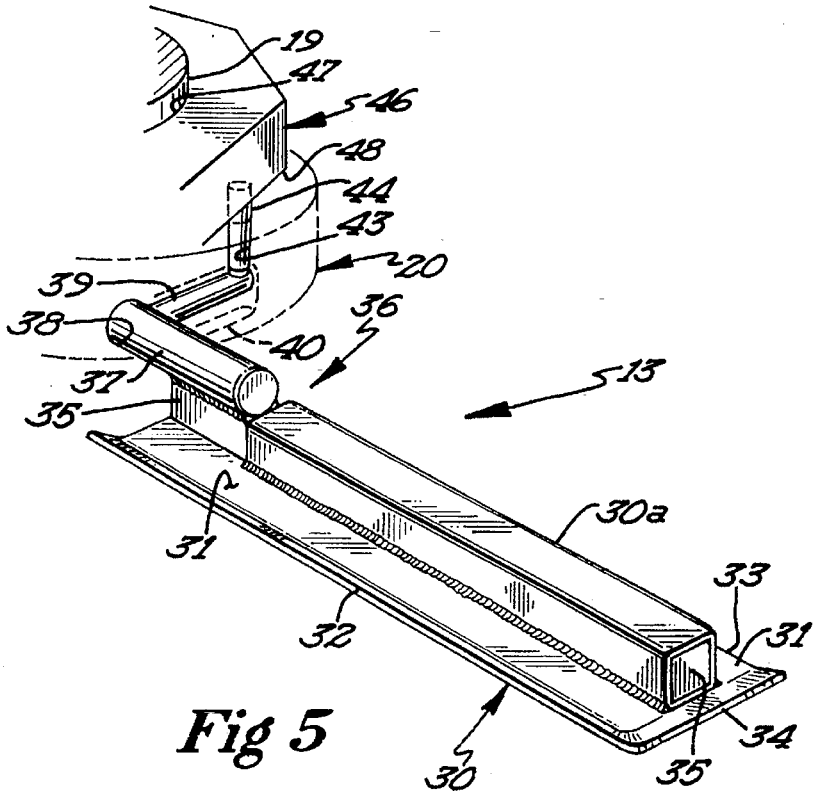
FIG. 5 is a fragmentary perspective view of a trowel blade member illustrating certain components thereof.

Each trowel subport bar 30*a* which is rigidly affixed to the upper surface of each trowel blade, and each elongate support bar 30*a* is substantially rectangular in cross-sectional shape in the embodiment shown. The inner end of each elongate support bar 35 has a crank member 36 rigidly affixed thereto as by welding as best seen in FIG. 5. It will be noted that each crank member 36 includes a cylindrical pin or arm 37 which projects into a radially extending horizontal cylindrical bore 38 in the hub. The horizontal radial cylindrical bores 38 communicate with the central axial vertical bore 20*b* in the hub 20. Each crank member 36 also includes an elongate pin or arm 39 rigidly affixed to the pin 37 intermediate the ends of the latter and projecting laterally therefrom. Each pin 39 is disposed in one of plurality of vertical slots 40 as best seen in FIG. 3.

Referring again to FIGS. 3 and 4, it will be seen that the vertical slots 40 are each slightly longer than the corresponding pin 39 and each slot communicates with the horizontal radial cylindrical bore 38 which contains the associated cylindrical arm 37. It will further be noted that the vertical slots 40 are arranged in parallel pairs, as best seen in FIG. 3. The slots 40 as well as the central axial bore 20*b* open downwardly through the lower end of the hub 20 and a suitable cover plate 41 is provided which is secured to the hub by suitable bolts 42.

The interrelation of the crank members 36 with respect to the hub 20 permit vertical tilting of the trowel blade members 30 about their respect longitudinal axes. Means are provided for shifting the crank members 36 in their associated slots 40 to accomplish this tilting of the trowel blade members. In this regard, it will be noted that the hub 20 is provided with a plurality of vertical openings or bores 43 which extend from the upper end of the hub downwardly and each vertical opening communicates with one of the slots 40. Each vertical opening 43 accommodates one of a plurality of elongate generally cylindrical pins 44 therein, the lower end of each pin 44 engaging one end of one of the arms 39. It will be noted that when the trowel blade members 30 are in the flat position, the upper ends of the pins 44 project beyond the upper surface of the hub 20. It will further be noted that when the pins 44 are shifted downwardly, each pin will cause the associated arm 39 to be tilted downwardly as best seen in FIG. 4 to thereby tilt a trowel blade member 30 about its longitudinal axis from a horizontal position to a tilted position as best in seen in FIG. 5. It will be noted that when the blade is in the tilted position, the leading edge of the blade is tilted upwardly. The trowel blade members can be adjusted to a 0 to 20 degree blade pitch and the blade assembly can be rotated at a maximum speed of 150 RPM's.

Means are also provided for actuating or moving the elongate pins 44 to cause tilting of the trowel blade members, and this tilt actuating mechanism, designated generally by the reference numeral 45, includes an octagonal ring member 46 having a central opening 47 therein which is positioned around the cylindrical gear reduction device 17 for vertical movement relative thereto. The octagonal ring member 46 has a substantially flat lower surface 48 which is disposed in engaging relation with the upper ends of the pins 44, as best seen in FIG. 4. A pair of L-shaped, vertically disposed, depending brackets 49 each having a horizontal ear 50 integrally formed therewith are secured to the annular edge portions of the lower wall 17*a* of the electric outer motor by bolts 51. It will be noted that the brackets 49 are disposed on opposite sides of the gear reduction device and depend downwardly therefrom.

The lower ends portions of each bracket 49 is pivotally connected to a U-shaped actuator member or fork 53 by a pivot 52. The free ends of the U-shaped actuator member 53 are pivotally connected to the octagonal ring member 46 by pivots 54.

It will be seen that the U-shaped actuator member 53 is provided with an ear or bracket plate 53*a* which projects therefrom through a vertical slot 55 in the cylindrical cover 23. In this regard, it will be noted that the U-shaped actuator member 53 is positioned interiorally of the cylindrical cover 23*a* and the bracket plate 53*a* projects exteriorly thereof. An elongate vertically actuating rod has its lower end pivotally connected to the bracket plate 53*a* by pivot 57 which is retained in connected relation with the U-shaped actuator member by a suitable cotter pin. The actuating rod 56 projects upwardly through an apertured L-shaped bracket 58 which is secured to the radial flange 17*a* of the gear reduction device 17. It will be noted that the rod 56 is threaded and projects upwardly through a vertically disposed tube 59.

The upper end of the rod 56 has an adjusting rod 60 secured thereto and it will be noted that the adjustment rod is positioned against the upper end of the tube 59. A nut 61 threadedly engages the rod 56 and is engaged by the lower end of the tube 59. With this arrangement, it will be seen that when the rod 56 is shifted vertically, the octagonal ring member 46 will be moved or translated downwardly thereby urging the pins 44 downwardly to shift the crank members and trowel blade members to the tilted position. This shifting is accomplished by rotating the rod 56 relative to the nut 61 and the coaction of the rod threads with respect to the nut threads retains the trowel blade members in the selected tilted angular position. The reverse procedure allows the trowel blade members to be returned to the normal flat position and in this regard, the reaction of the mass of the electric motor assembly and shroud urge the trowel blade members to the flat position as the rod is rotated to an upward position.

Referring again to FIG. 1, it will be seen that the electric motor 15 is provided with a circular cap 62 having an annular downturned peripheral or annular flange. A carrying handle structure 63 is positioned upon the cap 62 and includes a circular base 64 having a U-shaped handle 65 integrally formed therewith and projecting upwardly therefrom. The base 64 is suitably apertured and accommodates threaded bolts which extend through the cap 62 and threadedly engage in the upper end of the electric motor 15. The U-shaped handle 65 facilitates carrying of the rotary trowel device by a user.

An apertured clevis type attachment bracket 66 is integrally formed with the base 64 and is pivotally connected to one end of an elongate adjustment rod 67 by suitable pivot. In this regard, it will be noted that the end of the adjustment rod which engages the clevis bracket 66 is flattened for suitable mating with the bracket. The other end of the end of the rod 67 is journaled on the end of a adjustment bolt provided with an adjustment knob 69 that extends through apertures in the split sleeve bracket 68. With this arrangement, the adjustment knob may be loosened to allow the split sleeve bracket to be slid longitudinally along the handle 14 for adjusting the angular position of the handle with respect to a user.

The upper end of the elongate handle 14 is provided with a cross handle 70 which serves as hand grips and this cross handle projects through a control box 71 which is mounted on the upper end of the handle 14. The control box 71 contains a solid state, variable voltage DC motor control 72 which controls the speed of the motor and which converts (rectifies) AC to DC. The power conversion is accomplished through a full semiconductor bridge with diodes in two legs of the bridge and SCR's in the other two legs. AC voltage is converted to DC by the bridge and DC voltage level is controlled by controlling the phase angle firing of the SCR's. A commutating diode provides a path for current during phase back operation as well as helping minimize DC output ripple.

The SCR firing circuit controls the phase angle firing of the SCR response to signals from the regulator circuitry. The regulator circuit compares the speed command (from the speed setting potentiometer) with the actual motor voltage level. The resulting error signal is amplified and used to control the firing circuit.

A signal proportional to armature current is fed into the regulator to compensate for speed change due to load. A signal proportional to armature current is also used in the current limit circuit. The current feedback signal is compared against a set point signal. If the current rises above the current set point, the SCR's are phased back to limit the current to the set point. The above described circuitry is essentially solid state and is contained within the control box 71. It is thought that the description is sufficient without the need of a circuit diagram.

A conductor cable 73 is electrically connected to the rectifier and potentiometer 72*a* and is provided with a suitable bayonet type male socket element for connection to a conventional wall outlet. However, dual voltage feature allows the control to operate on either 115 VAC or 230 VAC input. The adjustment box also has a deadman type on-off switch 74 which is normally urged to the off position and must be held in the on position during operation of the trowel device. The elongate handle 14 is also provided with U-shaped cord retaining elements that permit the cord to be suitably looped over these elements when the rotary trowel device is not being used.

In use, the rotary trowel device will be operated by a user to spread and finish a concrete surface. After the concrete surface is poured, the user will operate the device to facilitate spreading of the concrete by first tilting the trowel blade members 30 from the normal flat position to a tilted position. As pointed out above, this is readily achieved by actuating the actuating rod 56 by means of the adjustment knob 60. The desired tilt will be obtained so that the leading edge of the trowel blade members will be tilted upwardly and will allow the slurry like concrete to be effectively spread while finishing the surface. As the concrete thickens and begins to set, the blades may be adjusted to a more flattened position for final finishing.

It will be seen that the rotary trowel device permits the blades to be readily adjusted by merely rotating the adjustment rod in a manner which holds the blades in the adjusted position by the interaction of the rod with the nut 61. All of the components of the trowel blade assembly shifting means awe primarily contained within the hub or are located within the cylindrical cover 23 above the imperforate shroud 12. Therefore precise adjustment of the blade tilt can be accomplished while minimizing if not precluding any fouling of the actuating components during operation of the rotary trowel device.

Since the power system for the rotary trowel device is electrical, the device is readily usable in confined areas and for inside work. This is not possible with most prior art rotary trowel devices. A highly efficient drive system is provided wherein the output shaft of the electric motor is disposed in axial alignment with the output shaft of the gear reduction drive which is in turn connected to the hub of the trowel blade assembly. This simple in line drive arrangement is unlike the drive systems of any of the prior art rotary trowel devices.

Thus it will be seen that I have provided a novel rotary trowel device which functions in a more efficient manner than any heretofore know comparable device.

What is claimed is:

1. A rotary trowel for smoothing and finishing a concrete surface, comprising, a generally horizontal, imperforate circular shroud having down turned peripheral edge portions and a central opening therein, an electric motor assembly mounted on said shroud and including a DC electric motor having a vertically disposed output shaft, a speed reduction device drivingly connected to the electric motor output shaft and having an output shaft disposed in axial alignment with the electric motor output shaft, an elongate handle having one end thereof connected with said electric motor assembly and extending angularly therefrom, a rotary trowel blade assembly positioned below said shroud and having a hub member connected to the output shaft of the speed reduction device, said rotary trowel blade assembly including a plurality of trowel blade members each comprising a substantially flat trowel blade element having an upturned leading edge and a trailing edge, connecting means projecting into and adjustably connecting each of said blade members to said hub member to permit tilting of said blade members about their respective longitudinal axes, said connecting means for each blade member being spaced from the connecting means for the other blade members, shifting means extending into said hub member and engaging said connecting means for shifting said connecting means to cause movement of said blade members between tilted and non-tilted positions, an actuating means engaging said shifting means for shifting and retaining said blade members in a tilted position.

2. The rotary trowel as defined in claim 1 wherein said connecting means for each trowel blade member comprises a crank element.

3. The rotary trowel as defined in claim 1 wherein shifting means for shifting said connecting means comprises a plurality of vertically disposed, non-attached pins, each being positioned in one of a plurality of vertical bores in said hub member.

4. The rotary trowel as defined in claim 1 wherein said actuating means includes an annular member mounted on said electric motor assembly and engaging said shifting means, said annular member being vertically translatable relative to said electric motor assembly to produce shifting movement of the trowel blade members between tilted and non-tilted positions.

5. The rotary trowel as defined in claim 1 and a control box mounted on said handle for ready access by a user, said control box including a rectifier for rectifying AC current, and a potentiometer for controlling the speed of the electric motor assembly.

6. The rotary trowel as defined in claim 1 wherein said speed reduction device includes a speed reduction housing, a pinion in said speed reduction housing drivingly connected to the output shaft of the electric motor and being disposed in axial alignment therewith, a pair of helical gears in said housing and each including an upper and lower gear element, the upper gear element of each helical gear engaging said pinion, the lower gear element of each helical gear engaging a helical gear on the output shaft of the gear reduction device.

7. The rotary trowel device as defined in claim 6 wherein the diameter of the upper gear element of each helical gear is substantially greater than the diameter of the lower gear element.

* * * * *